US011469555B1

(12) United States Patent
Wang

(10) Patent No.: US 11,469,555 B1
(45) Date of Patent: Oct. 11, 2022

(54) WATERPROOF POWER PLUG AND STRING LIGHT USING THE WATERPROOF POWER PLUG

(71) Applicant: Dongguan Venus Optoelectronics Technology Co., Ltd, Dongguan (CN)

(72) Inventor: Zhonghua Wang, Dongguan (CN)

(73) Assignee: DONGGUAN VENUS OPTOELECTRONICS TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/451,636

(22) Filed: Oct. 20, 2021

(30) Foreign Application Priority Data

Sep. 9, 2021 (CN) ..... 202111058982.6

(51) Int. Cl.

| | |
|---|---|
| ***H01R 13/692*** | (2011.01) |
| ***H01R 13/52*** | (2006.01) |
| ***F21S 4/10*** | (2016.01) |
| ***F21V 25/10*** | (2006.01) |
| ***F21V 23/06*** | (2006.01) |

(52) U.S. Cl.
CPC ..... *H01R 13/692* (2013.01); *F21S 4/10* (2016.01); *F21V 23/06* (2013.01); *F21V 25/10* (2013.01); *H01R 13/5213* (2013.01)

(58) Field of Classification Search
CPC .... H01R 13/692; H01R 13/68; H01R 13/696; H01R 13/44; H01R 13/447; H01R 13/5213; F21S 4/10
See application file for complete search history.

(56) References Cited

U.S. PATENT DOCUMENTS 5,791,941 A * 8/1998 Wang ..... H01R 13/68 439/589
2007/0007030 A1* 1/2007 Murphy ..... H01R 13/5213 174/92
2010/0039803 A1* 2/2010 Lexso ..... F21V 23/06 362/227

FOREIGN PATENT DOCUMENTS

CA 2291433 A1 * 6/2001 ..... H01R 13/516
CN 206506104 U * 9/2017
CN 211045862 * 2/2020
CN 213484067 U * 6/2021
CN 213717204 U * 7/2021

* cited by examiner

*Primary Examiner* — Anabel Ton
(74) *Attorney, Agent, or Firm* — Shimokaji IP

(57) ABSTRACT

A waterproof power plug includes a mounting frame, first and second conductive terminals, a fuse, and a fuse cover which are mounted inside the mounting frame. The fuse is electrically connected to the second conductive terminal. The mounting frame is provided with a mounting groove for exposing the fuse, and the fuse cover is mounted in the mounting groove to cover or expose the fuse. The power plug further includes a housing opened with a window for slidably operating the fuse cover, and a waterproof cover is mounted in the window. Therefore, the fuse cover is arranged on the mounting groove and the waterproof cover is further covered on the fuse cover, which provides multiple waterproof protections. The power plug has a good sealing performance and waterproof performance, which also helps to improve the overall waterproof performance and work safety of the string light with the power plug.

20 Claims, 10 Drawing Sheets

7

WATERPROOF POWER PLUG AND STRING LIGHT USING THE WATERPROOF POWER PLUG

RELATED APPLICATIONS

This application claims the benefit of priority to Chinese application No. 202111058982.6 filed on Sep. 9, 2021, which is hereby incorporated by reference in its entirety.

FIELD OF THE INVENTION

The present invention relates to the technical field of power plugs, in particular to a waterproof power plug and a string light using the waterproof power plug.

BACKGROUND OF THE INVENTION

Outdoor string lights, such as LED Christmas string lights, include multiple sets of string light units. Each string light unit includes a power cord, a plurality of lamp holders arranged on the power cord and electrically connected to the power cord, and lamps disposed on the lamp holders. Moreover, a plug and a corresponding socket are respectively connected at both ends of the power cord, and multiple sets of string light units are electrically connected through a plug-in connection of the plugs and the corresponding sockets. The plug with replaceable fuse is commonly used in outdoor string lights. A fuse is mounted inside the plug, which can cut off the power in time to protect the safety of string lights and people when it is over-current. The outdoor string lights are easy to leak electricity in the rainy or humid outdoor environment. In order to prevent water from penetrating into the fuse mounting slot, a cover plate is provided at an opening of the fuse mounting slot. However, it is easy to form a gap at a joint position between the cover plate and the plug housing, which will cause a poor sealing effect. It is still unavoidable to infiltrate the water when the string lights are used outdoors for a long time, which not only affects the service life of the string lights, but even causes danger.

In order to solve the above-mentioned problems, the present invention provides a power plug and a string light using the waterproof power plug, which are waterproof and leak-proof.

SUMMARY OF THE INVENTION

Objectives of the present invention are to provide a power plug and a string light using the waterproof power plug, which are waterproof and leak-proof.

To achieve the above objectives, the present invention provides a waterproof power plug which includes a mounting frame, a first conductive terminal, a second conductive terminal, a fuse, and a fuse cover which are mounted inside the mounting frame. The fuse is electrically connected to the second conductive terminal. The mounting frame is provided with a mounting groove for exposing the fuse, and the fuse cover is mounted in the mounting groove and operable to slide to cover or expose the fuse. The waterproof power plug further includes a housing for housing the mounting frame in the inside thereof. A surface of the housing corresponding to the mounting groove is opened with a window for accessing the fuse cover and slidably operating the fuse cover, and a waterproof cover is mounted in the window.

Preferably, one end of the first conductive terminal is a plug end protruding from the mounting frame, and the other end is a connecting end protruding from the mounting frame. The second conductive terminal includes a plug portion and a connecting portion which are separate and respectively protruded from the mounting frame, and the fuse is electrically connected to the plug portion and the connecting portion of the second conductive terminal.

Preferably, the waterproof cover is connected to the housing by a connecting strap.

Preferably, the waterproof cover is flexibly connected to the housing and integrally molded with the housing.

Preferably, a waterproof platform is protruded from the surface of the housing along an outer periphery of the window.

Preferably, a top surface of the waterproof cover is extended downwards to form a step-shaped eave which covers the waterproof platform.

Preferably, a top surface of the waterproof cover is protruded upwards to form a pulling part for pulling the waterproof cover.

Preferably, a front end of the surface of the housing is protruded out to form a protruding portion in a circumferential direction of the housing, and the pulling part is butted with the protruding portion to form a closed ring-shaped protective portion.

Preferably, a side wall of the mounting groove is provided with a moving groove for the fuse cover to slide, and the fuse cover is narrowed along a direction in which the fuse cover is inserted into the moving groove.

Preferably, the fuse cover includes a toggle portion, a first inserting portion, and a second inserting portion, the width of the first inserting portion is greater than the width of the second inserting portion, and the length of the moving groove is equal to the length of the first inserting portion.

Preferably, the first inserting portion and the second inserting portion are transitionally connected by an inclined portion, the side wall of the mounting groove protrudes to form a shielding portion, and the shielding portion is located below the second inserting portion.

Accordingly, the present invention further provides a waterproof string light which includes a power cord, a plurality of lamp holders electrically connected to the power cord, a plurality of lamps mounted on the plurality of lamp holders, and a waterproof power plug above. The plurality of lamp holders are arranged at intervals on the power cord, and a head end of the power cord is connected to the waterproof power plug.

Preferably, a tail end of the power cord is connected to a waterproof socket having a waterproof socket cover.

In the present invention, the waterproof power plug includes a mounting frame, a first conductive terminal, a second conductive terminal, a fuse, and a fuse cover which are mounted inside the mounting frame. The fuse is electrically connected to the second conductive terminal. The mounting frame is provided with a mounting groove for exposing the fuse, and the fuse cover is mounted in the mounting groove and operable to slide to cover or expose the fuse. The waterproof power plug further includes a housing for housing the mounting frame in the inside thereof. A surface of the housing corresponding to the mounting groove is opened with a window for accessing the fuse cover and slidably operating the fuse cover, and a waterproof cover is mounted in the window. Therefore, the fuse cover is arranged on the mounting groove and the waterproof cover is further covered on the fuse cover, which provides multiple waterproof protections. The power plug has a simple structure, good sealing performance, and waterproof performance, which at the same time also helps to improve the overall waterproof performance and work safety of the string light and further improves the working life of the string light.

BRIEF DESCRIPTION OF THE DRAWINGS

The accompanying drawings facilitate an understanding of the various embodiments of this invention. In such drawings.

In the aforementioned Figures.

Figure 1:
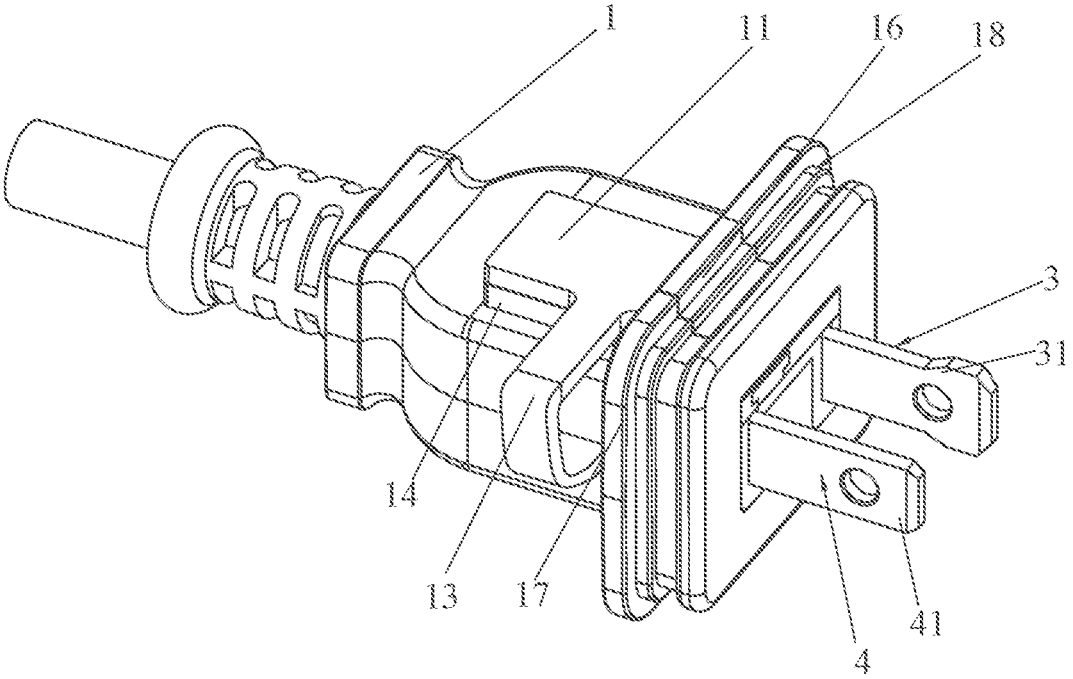
FIG. 1 is a perspective view of a waterproof power plug when a waterproof cover is covered according to an embodiment of the present invention.

waterproof power plug 10; housing 1; waterproof cover 11; window 12;

connecting strap 13; waterproof platform 14; eave 15; pulling part 16; protruding portion 17; protective portion 18; mounting frame 2; mounting frame body 21; plug hole 211; connecting hole 212; separation plate 213; receiving groove 214; positioning rib 215; cover body 22; mounting groove 221; moving groove 222; shielding portion 223; fixing portion 224; first conductive terminal 3; plug end 31; connecting end 32; second conductive terminal 4; plug portion 41; connecting portion 42; first connecting groove 43; second connecting groove 44; fuse 5; fuse cover 51; toggle portion 511; first inserting portion 512; second inserting part 513; inclined portion 514; string light 100; power cord 6; connecting frame 61; waterproof socket 7; waterproof socket cover 71; fixing frame 72; conductive clip 73; socket housing 74; lamp holder 8; lamp 9.

DETAILED DESCRIPTION OF ILLUSTRATED EMBODIMENTS

In order to explain in detail the technical content, construction features, the purpose and effect achieved by the present invention, the following combined with the implementation and the attached drawings are described in detail.

Figure 2:
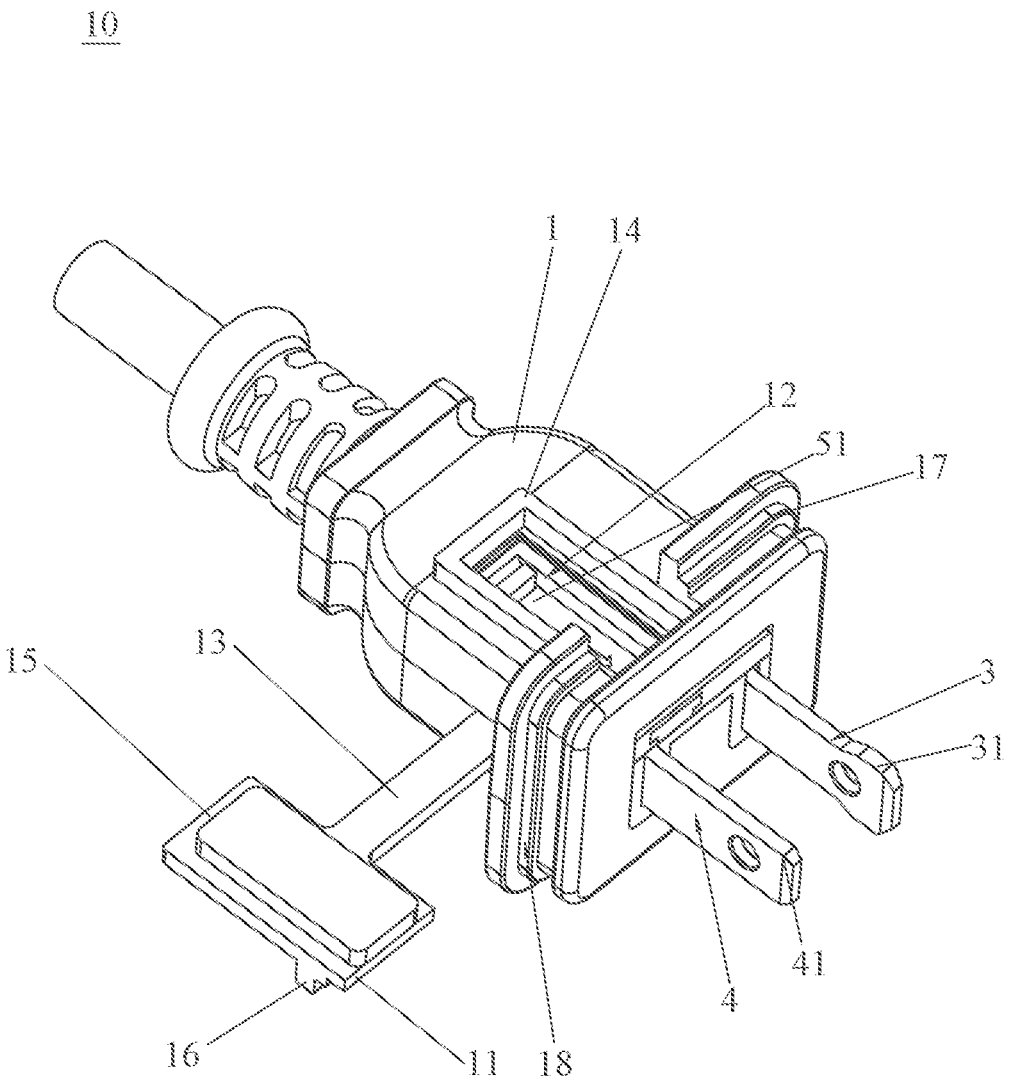
FIG. 2 is a perspective view of the waterproof power plug when the waterproof cover is opened.
Figure 3:
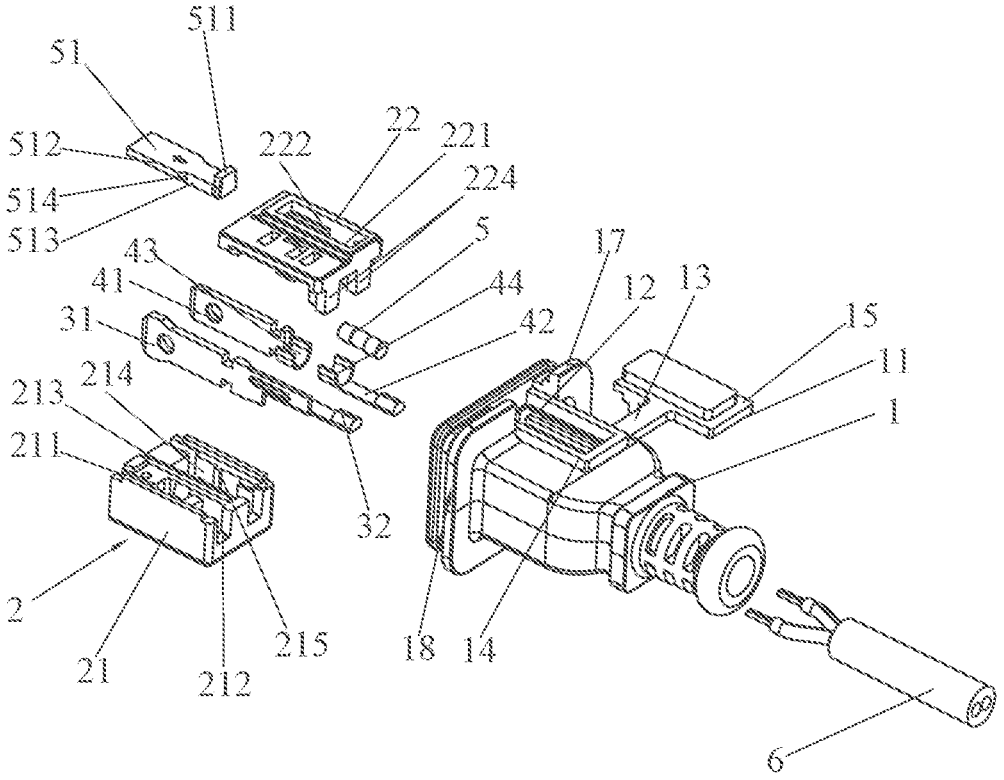
FIG. 3 is an exploded view of the waterproof power plug in FIG. 1.

As shown in FIGS. 1-3, in this embodiment, a waterproof power plug 10 includes a housing 1, a mounting frame 2 housed in the housing 1, and a first conductive terminal 3, a second conductive terminal 4, a fuse 5, and a fuse cover 51. The mounting frame 2 includes a mounting frame body 21 and a cover body 22 disposed on the mounting frame body 21. One end of the first conductive terminal 3 is a plug end 31 that protrudes out of the mounting frame body 21, and the other end is a connecting end 32 that protrudes out of the mounting frame body 21. The second conductive terminal 4 includes a plug portion 41 and a connecting portion 42 which are separate and respectively protruded from the mounting frame body 21. Understandably, the plug end 31 and the plug portion 41 will be inserted into a corresponding socket, and the connecting end 32 and the connecting portion 42 are arranged for connecting a power cord 6. The fuse 5 is electrically connected to the plug portion 41 and the connecting portion 42 of the second conductive terminal 4. The cover body 22 is provided with a mounting groove 221 for exposing the fuse 5, and the fuse cover 51 is inserted in the mounting groove 221 and operable to slide to cover or expose the fuse 5. A surface of the housing 1 corresponding to the mounting groove 221 is opened with a window 12 for accessing the fuse cover 51 and slidably operating the fuse cover 51, and a waterproof cover 11 is mounted in the window 12.

Figure 4:
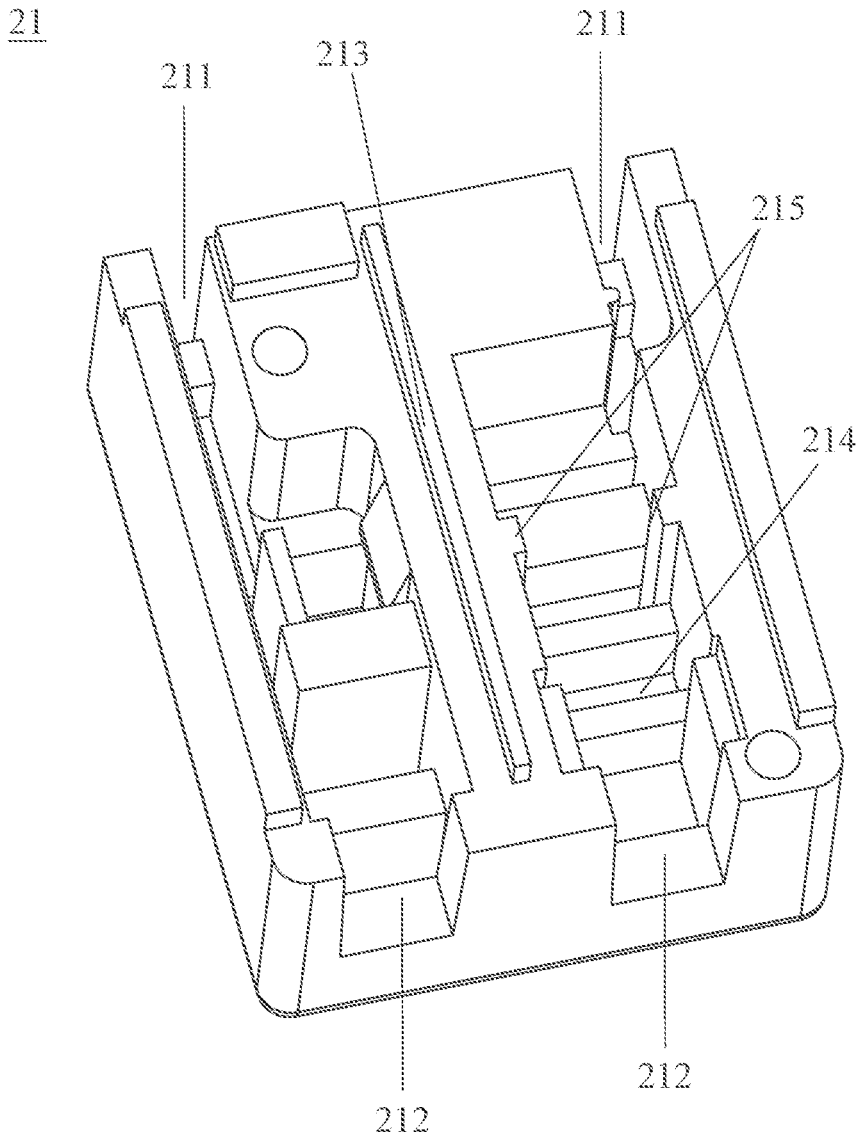
FIG. 4 is a perspective view of a mounting frame body.

Of course, it is understandable that both the mounting frame body 21 and the cover body 22 may be detachable, or may be an integrated structure. As shown in FIGS. 3-4, a front side wall of the mounting frame body 21 is provided with two plug holes 211 from which the plug end 31 of the first conductive terminal 3 and the plug portion 41 of the second conductive terminal 4 protrude. A rear side wall of the mounting frame body 21 is provided with two connecting holes 212 from which the connecting end 32 of the first conductive terminal 3 and the connecting portion 42 of the second conductive terminal 4 protrude. A separation plate 213 is disposed in the mounting frame body 21 for separating the first conductive terminal 3 and the second conductive terminal 4, and the mounting frame body 21 has a receiving groove 214 for mounting the fuse 5. Preferably, positioning ribs 215 are protruded from left and right side walls of the receiving groove 214, and the positioning ribs 215 fix the fuse 5 from the side. The fuse 5 is disposed in the receiving groove 214 and connected to the plug portion 41 and the connecting portion 42 of the second conductive terminal 4.

Figure 5:
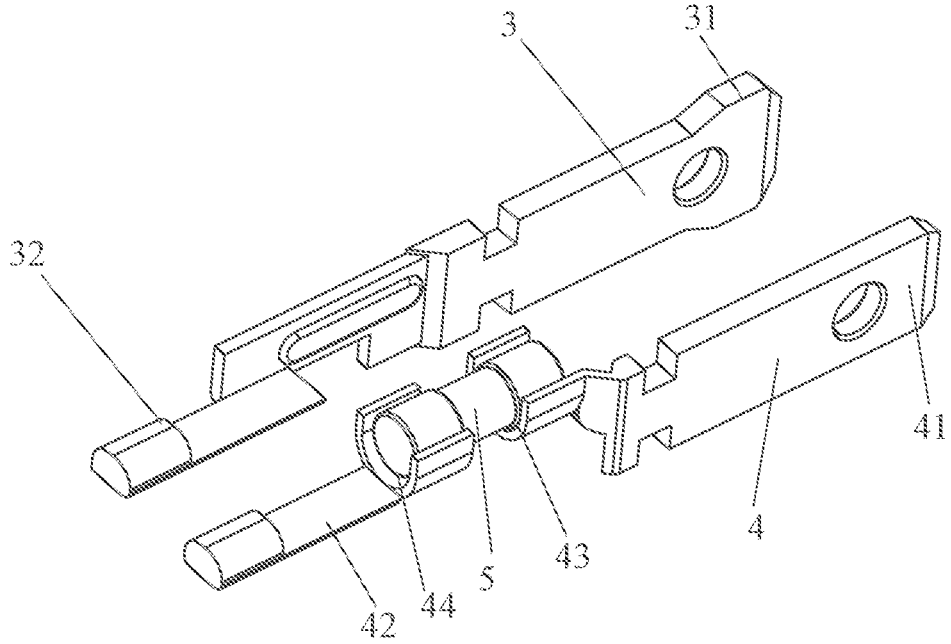
FIG. 5 is a perspective view showing a first conductive terminal, a second conductive terminal and a fuse.

Referring to FIGS. 3 and 5, the plug end 31 of the first conductive terminal 3 extends from the corresponding plug hole 211 out of the mounting frame body 21, and the connecting end 32 extends out of the mounting frame body 21 from the corresponding connecting hole 212 and is connected power cord 6. Tail end of the plug portion 41 has a U-shaped first connecting groove 43, head end of the connecting portion 42 has a U-shaped second connecting groove 44, and tail end of the connecting portion 42 is a clamping portion for clamping the power cord 6. Two ends of the fuse 5 are respectively fixed in the U-shaped first connecting groove 43 and the second connecting groove 44. Of course, the shape of the first connecting groove 43 and the second connecting groove 44 is not limited to U-shaped, as long as the fuse 5 can be fastened. More specifically, the connecting end 32 and the tail end of the connecting portion 42 are both copper clips to fix with the conductors of the power cord 6. After the cover body 22 and the mounting frame body 21 are fixed, the copper clips are respectively fixed by fixing portions 224 on the cover body 22.

Referring to FIGS. 1-3 again, the waterproof cover 11 is flexibly connected to the housing 1 through a connecting strap 13. Preferably, the waterproof cover 11 and the housing 1 are integrally formed by injection molding. Preferably, a waterproof platform 14 is protruded from the surface of the housing 1 along an outer periphery of the window 12, and the waterproof platform 14 prevents water on the housing 1 from penetrating into the mounting groove 221 from the window 12. Preferably, a top surface of the waterproof cover 11 extends downwards to form a step-shaped eave 15 which matches with and covers the waterproof platform 14, and the waterproof cover 11 is inserted into the window 12 to cover the fuse cover 51. More preferably, the top surface of the waterproof cover 11 protrudes upward from a pulling part 16 for pulling the waterproof cover 11 so as to open the waterproof cover 11 to replace the fuse 5. Preferably, a front end of the surface of the housing 1 is protruded out to form a protruding portion 17 in a circumferential direction of the housing 1 and the pulling part 16 is butted with the protruding portion 17 to form a closed ring-shaped protective portion 18 to prevent the hand from touching a front end of the waterproof power plug 10 when a user uses the waterproof power plug 10 to avoid potential safety hazards.

Figure 6:
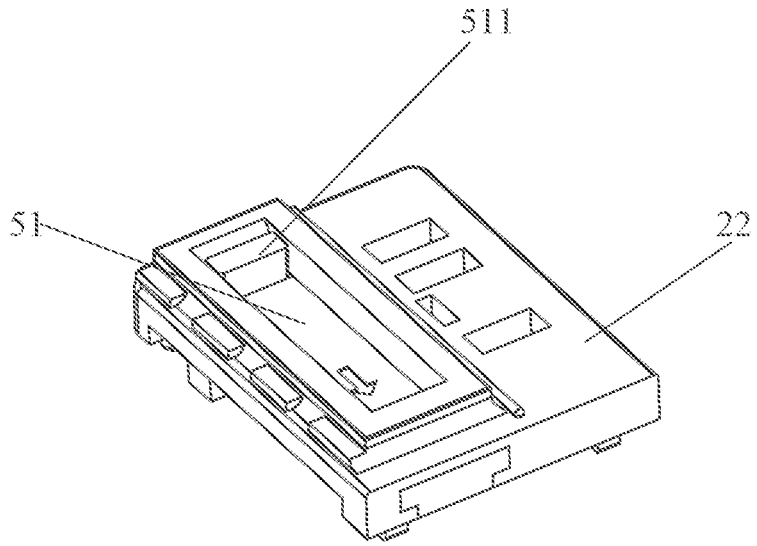
FIG. 6 is a perspective view showing that a fuse cover is completely covered on the mounting groove.
Figure 7:
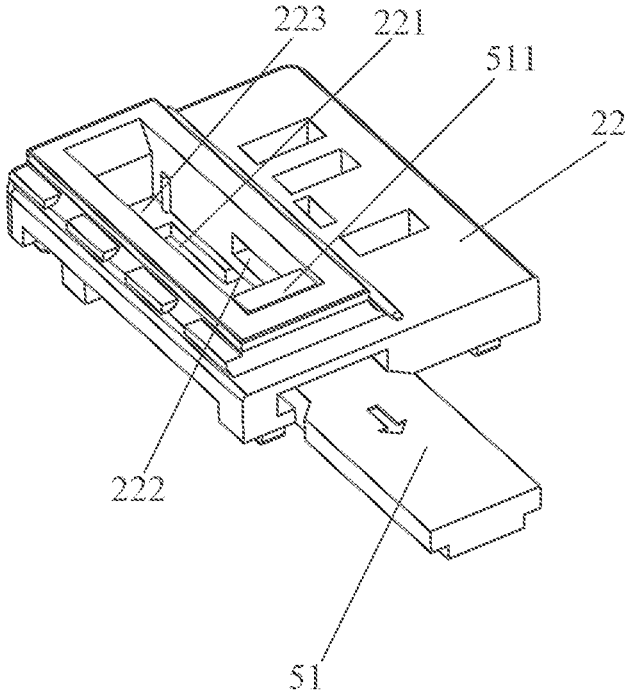
FIG. 7 is a perspective view showing that the fuse cover is partially covered on the mounting groove.
Figure 8:
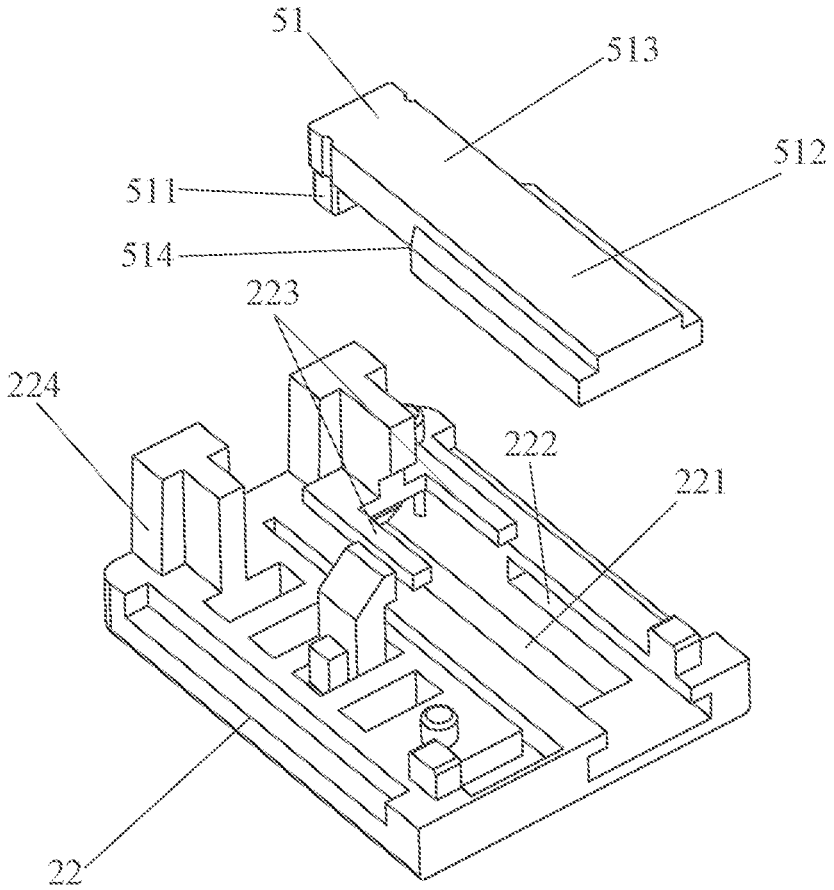
FIG. 8 is an exploded view of the fuse cover and a cover body.

As shown in FIGS. 6-8, two side walls of the mounting groove 221 are opened with two moving grooves 222 for the fuse cover 51 to slide, and the fuse cover 51 is narrowed along a direction in which the fuse cover 51 is inserted into the moving groove 222. Specifically, the fuse cover 51 includes a toggle portion 511, a first inserting portion 512, and a second inserting portion 513. The width of the first inserting portion 512 is greater than the width of the second inserting portion 513, and the length of the moving grooves 222 is equal to the length of the first inserting portion 512. Preferably, the first inserting portion 512 and the second inserting portion 513 are transitionally connected by an inclined portion 514, the two side walls of the mounting groove 221 respectively protrudes from the shielding portions 223, and the shielding portions 223 are located below the second inserting portion 513. Therefore, the fuse cover 51 slides in the moving grooves 222, when side walls of the inclined portions 514 touch ends of the moving grooves 222, the fuse cover 51 continues to insert along the mounting groove 221 until the fuse cover 51 completely covers the mounting groove 221. In this way, the fuse cover 51 is securely inserted into the moving groove 222 and prevented from accidentally slipping out. Since the side walls of the mounting groove 221 protrude to form the shielding portions 223, when the fuse cover 51 completely covers the mounting groove 221, the shielding portions 223 are located below the second inserting portion 513, which prevents water from penetrating into the mounting groove 221 from an outer edge of the fuse cover 51.

Figure 9:
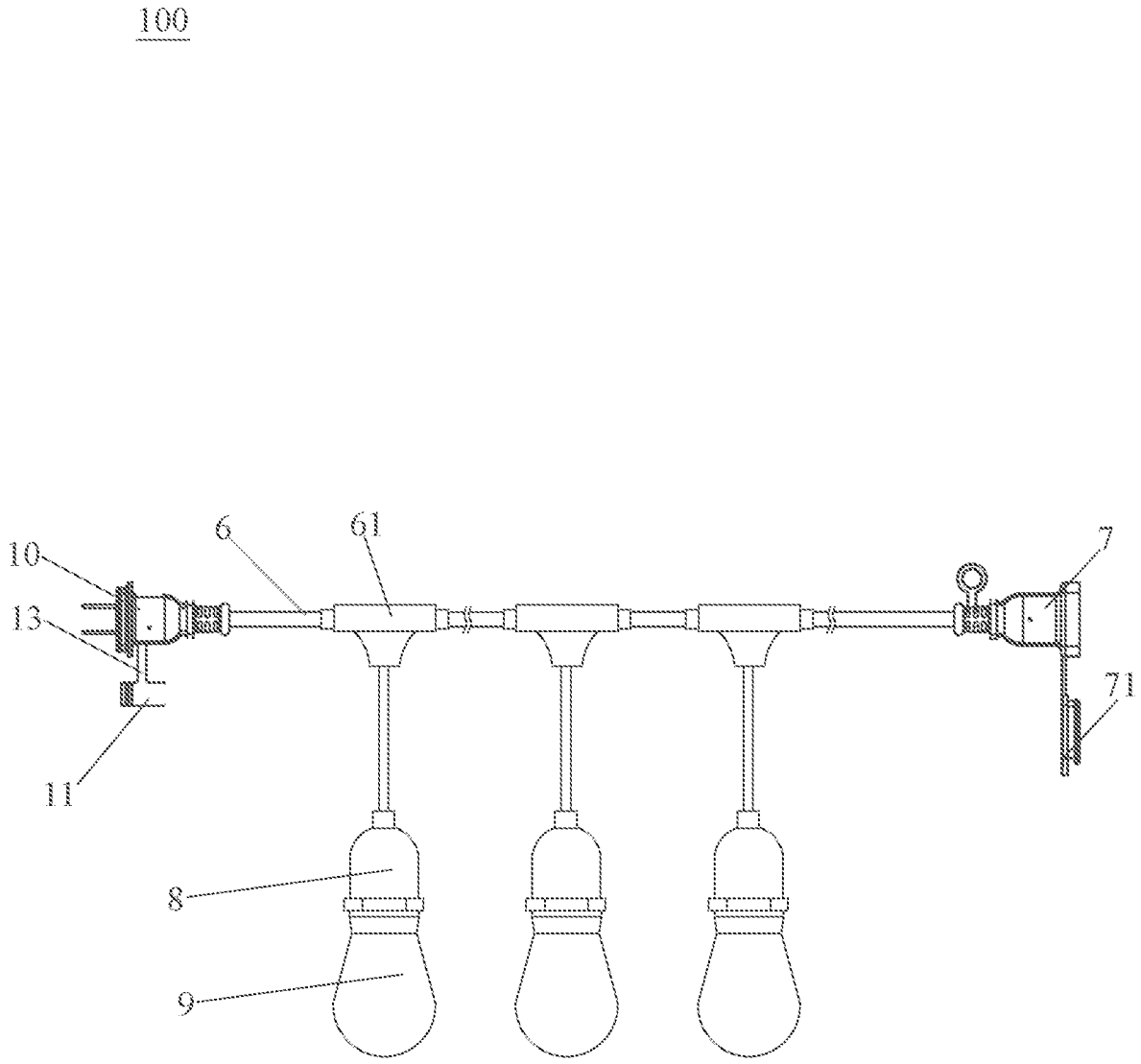
FIG. 9 is a perspective view of a string light according to an embodiment of the present invention.
Figure 10:
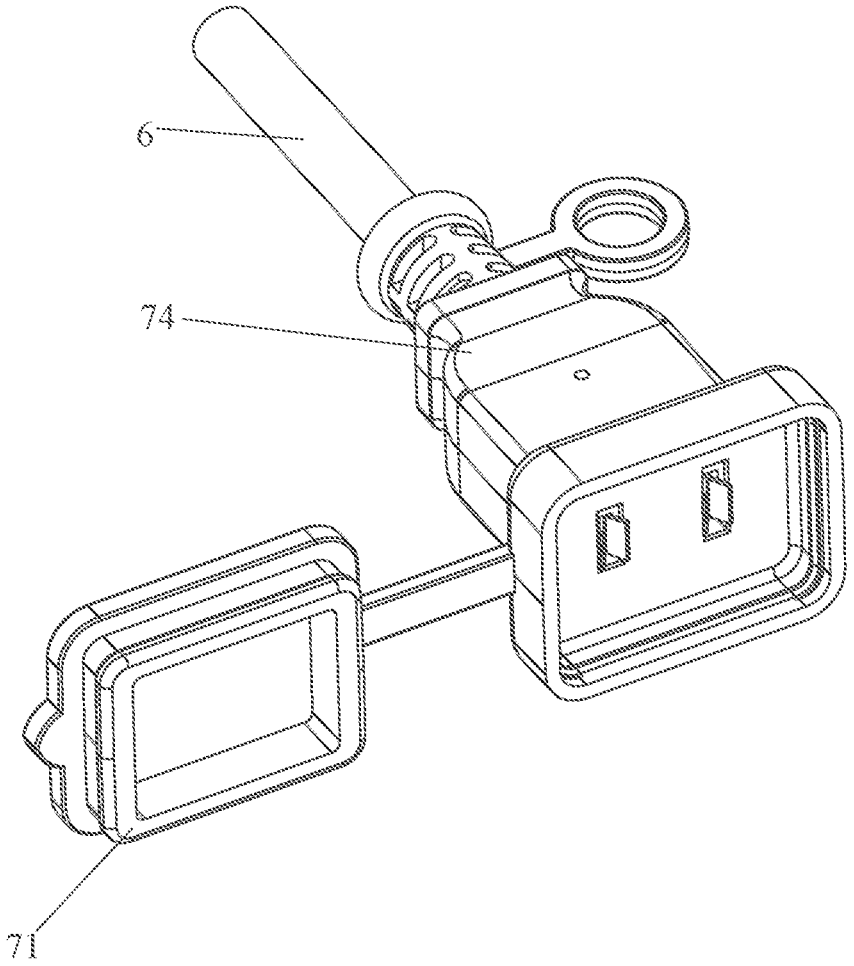
FIG. 10 is a perspective view of a waterproof socket.
Figure 11:
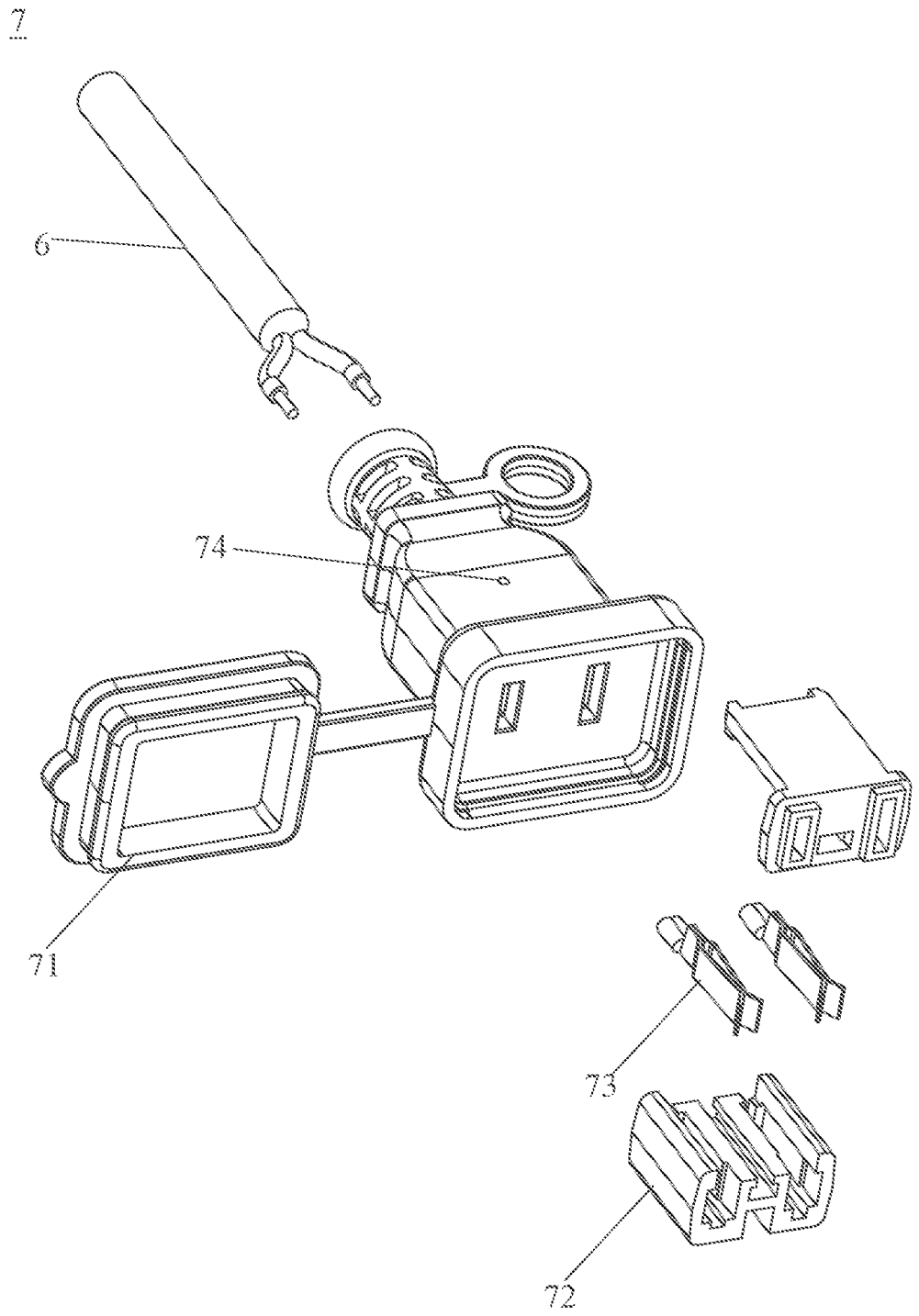
FIG. 11 is an exploded view of the waterproof socket in FIG. 10.

As shown in FIG. 9, the present invention also provides a waterproof string light 100 which includes a power cord 6, a plurality of lamp holders 8 electrically connected to the power cord 6, a plurality of lamps 9 respectively mounted on the plurality of lamp holders 8 and the aforementioned waterproof power plug 10. The plurality of lamp holders 8 are arranged on the power cord 6 at intervals, and the head and tail ends of the power cord 6 are respectively connected to the waterproof power plug 10 and the waterproof socket 7. As shown in FIGS. 9-11, the waterproof socket 7 has a waterproof socket cover 71 integrally formed by injection molding. The waterproof socket 7 has a fixing frame 72 and a conductive clip 73 inside. The conductive clips 73 are connected to one end of the power cord 6 and protruded out from the fixing frame 72. Specifically, the fixing frame 72 is covered with a socket housing 74, and the socket housing 74 and the waterproof socket cover 71 are integrally formed. Specifically, the lamp holder 8 and the power cord 6 are connected by a connecting frame 61, and a waterproof housing is formed on an outer wall of the connecting frame 61 by injection molding. Therefore, connection point between the power cord 6 and the lamp holder 8, the plugs and sockets at both ends of the power cord 6 have good waterproof performance which reduces the potential safety hazards of leakage.

In the present invention, the waterproof power plug 10 includes the mounting frame 2, the first conductive terminal 3, the second conductive terminal 4, the fuse 5, and the fuse cover 51 which are mounted inside the mounting frame 2. The fuse 5 is electrically connected to the second conductive terminal 4. The mounting frame 2 is provided with the mounting groove 221 for exposing the fuse 5, and the fuse cover 51 is mounted in the mounting groove 221 and operable to slide to cover or expose the fuse 5. The waterproof power plug 10 further includes a housing 1 for housing the mounting frame 2 in the inside thereof. A surface of the housing 1 corresponding to the mounting groove 221 is opened with the window 12 for accessing the fuse cover 51 and slidably operating the fuse cover 51, and the waterproof cover 11 is mounted in the window 12. Therefore, the fuse cover 51 is arranged on the mounting groove 221 and the waterproof cover 11 is further covered on the fuse cover 51, which provides multiple waterproof protections. The power plug 10 has a simple structure, good sealing performance, and waterproof performance, and at the same time also helps to improve the overall waterproof performance and work safety of the string light 100, and further improves the working life of the string light.

While the invention has been described in connection with what are presently considered to be the most practical and preferred embodiments, it is to be understood that the invention is not to be limited to the disclosed embodiments, but on the contrary, is intended to cover various modifications and equivalent arrangement included within the spirit and scope of the invention.

What is claimed is:

1. A waterproof power plug, comprising a mounting frame, a first conductive terminal, a second conductive terminal, a fuse, and a fuse cover which are mounted in the mounting frame, wherein the fuse is electrically connected to the second conductive terminal, the mounting frame is provided with a mounting groove for exposing the fuse, the fuse cover is mounted in the mounting groove and operable to slide to cover or expose the fuse, the waterproof power plug further comprises a housing for housing the mounting frame in the inside thereof, a surface of the housing corresponding to the mounting groove is opened with a window for accessing the fuse cover and slidably operating the fuse cover, and a waterproof cover is mounted in the window.

2. The waterproof power plug as claimed in claim 1, wherein one end of the first conductive terminal is a plug end protruding from the mounting frame, the other end is a connecting end protruding from the mounting frame, the second conductive terminal comprises a plug portion and a connecting portion which are separate and respectively protruded from the mounting frame, and the fuse is electrically connected to the plug portion and the connecting portion of the second conductive terminal.

3. The waterproof power plug as claimed in claim 1, wherein the waterproof cover is connected to the housing by a connecting strap.

4. The waterproof power plug as claimed in claim 1, wherein the waterproof cover is flexibly connected to the housing and integrally molded with the housing.

5. The waterproof power plug as claimed in claim 1, wherein a waterproof platform is protruded from the surface of the housing along an outer periphery of the window.

6. The waterproof power plug as claimed in claim 5, wherein a top surface of the waterproof cover is extended downwards to form a step-shaped eave which covers the waterproof platform.

7. The waterproof power plug as claimed in claim 1, wherein a top surface of the waterproof cover is protruded upwards to form a pulling part for pulling the waterproof cover.

8. The waterproof power plug as claimed in claim 7, wherein a front end of the surface of the housing is protruded out to form a protruding portion in a circumferential direction of the housing, and the pulling part is butted with the protruding portion to form a closed ring-shaped protective portion.

9. The waterproof power plug as claimed in claim 1, wherein a side wall of the mounting groove is provided with a moving groove for the fuse cover to slide, and the fuse cover is narrowed along a direction in which the fuse cover is inserted into the moving groove.

10. The waterproof power plug as claimed in claim 9, wherein the fuse cover includes a toggle portion, a first inserting portion, and a second inserting portion, the width of the first inserting portion is greater than the width of the second inserting portion, and the length of the moving groove is equal to the length of the first inserting portion.

11. The waterproof power plug as claimed in claim 10, wherein the first inserting portion and the second inserting portion are transitionally connected by an inclined portion, the side wall of the mounting groove protrudes to form a shielding portion, and the shielding portion is located below the second inserting portion.

12. A string light, comprising a power cord, a plurality of lamp holders electrically connected to the power cord, a plurality of lamps mounted on the plurality of lamp holders, and a waterproof power plug, wherein the plurality of lamp holders are arranged at intervals on the power cord, a head end of the power cord is connected to the waterproof power plug, the waterproof power plug comprises a mounting frame, a first conductive terminal, a second conductive terminal, a fuse, and a fuse cover which are mounted in the mounting frame, the fuse is electrically connected to the second conductive terminal, the mounting frame is provided with a mounting groove for exposing the fuse, the fuse cover is mounted in the mounting groove and operable to slide to cover or expose the fuse, the waterproof power plug further comprises a housing for housing the mounting frame in the inside thereof, a surface of the housing corresponding to the mounting groove is opened with a window for accessing the fuse cover and slidably operating the fuse cover, and a waterproof cover is mounted in the window.

13. The string light as claimed in claim 12, wherein a tail end of the power cord is connected to a waterproof socket having a waterproof socket cover.

14. The string light as claimed in claim 12, wherein the waterproof cover is connected to the housing by a connecting strap.

15. The string light as claimed in claim 12, wherein the waterproof cover is flexibly connected to the housing and integrally molded with the housing.

16. The string light as claimed in claim 12, wherein a waterproof platform is protruded from the surface of the housing along an outer periphery of the window.

17. The string light as claimed in claim 16, wherein a top surface of the waterproof cover is extended downwards to form a step-shaped eave which covers the waterproof platform.

18. The string light as claimed in claim 12, wherein a top surface of the waterproof cover is protruded upwards to form a pulling part for pulling the waterproof cover.

19. The string light as claimed in claim 18, wherein a front end of the surface of the housing is protruded out to form a protruding portion in a circumferential direction of the housing, and the pulling part is butted with the protruding portion to form a closed ring-shaped protective portion.

20. The string light as claimed in claim 12, wherein a side wall of the mounting groove is provided with a moving groove for the fuse cover to slide, and the fuse cover is narrowed along a direction in which the fuse cover is inserted into the moving groove.

* * * * *